United States Patent [19]

Haugsjaa et al.

[11] 4,065,701

[45] Dec. 27, 1977

[54] ELECTRODELESS LIGHT SOURCE WITH REDUCED HEAT LOSSES

[75] Inventors: Paul O. Haugsjaa, Acton; Alfred E. Feuersanger, Framingham, both of Mass.

[73] Assignee: GTE Laboratories Incorporated, Waltham, Mass.

[21] Appl. No.: 705,327

[22] Filed: July 14, 1976

[51] Int. Cl.[2] ..... H05B 41/16; H05B 41/24

[52] U.S. Cl. ..... 315/248; 315/39; 315/267; 315/344

[58] Field of Search ..... 315/248, 39, 151, 158, 315/159, 151, 104, 267, 283, DIG. 7, 344, 149; 250/504, 372, 373

[56] References Cited

U.S. PATENT DOCUMENTS

| | | | |
|---|---|---|---|
| 2,974,243 | 3/1961 | Marrison | 315/248 X |
| 2,975,330 | 3/1961 | Bloom et al. | 315/248 X |
| 3,138,739 | 6/1964 | Farmer | 315/248 |
| 3,786,308 | 1/1974 | Browner et al. | 315/248 |
| 3,860,854 | 1/1975 | Hollister | 315/248 |
| 3,943,401 | 3/1976 | Haugsjaa et al. | 315/39 |
| 3,987,335 | 10/1976 | Anderson | 315/248 |
| 3,989,983 | 11/1976 | Uchino et al. | 315/248 |

*Primary Examiner*—Saxfield Chatmon, Jr.
*Attorney, Agent, or Firm*—Irving M. Kriegsman; Leslie J. Hart; Fred Fisher

[57] ABSTRACT

Improved efficacy is obtained in an electrodeless light source of the type having a high frequency electrodeless lamp disposed at the ends of inner and outer conductors of a termination fixture by evacuating the region between the lamp envelope and the outer conductor to reduce conductive and convective heat losses.

9 Claims, 8 Drawing Figures

ELECTRODELESS LIGHT SOURCE WITH REDUCED HEAT LOSSES

BACKGROUND OF THE INVENTION

The present invention relates to an electrodeless light source excited by power in the microwave region of the electromagnetic spectrum.

In view of the necessity of conserving natural resources, much effort has recently been directed to research in electrodeless light sources. An electrodeless light source requires less electrical power than the conventional incandescent light source which in turn reduces the demand for fossil fuels for power generating facilities.

An electrodeless light source is described in the U.S. patent to Haugsjaa et al., No. 3,943,403 which is assigned to the same assignee as the present invention. This light source includes a source of power at a high frequency, such as in the range of 10 MHz to 300 GHz, and an electrodeless lamp having an envelope made of a light-transmitting material and a volatile fill material within the envelope. The fill material emits light upon breakdown and excitation. A termination fixture is coupled between the source and the lamp and has an inner conductor and an outer conductor disposed around the inner conductor, one pair of ends of the conductors being coupled to the lamp while the other pair is coupled to the source. The fixture has the capability of matching the impedance of the lamp during the state of excitation to the output impedance of the source to optimize the coupling of microwave power to the lamp. Lamps according to this arrangement have been operated with light outputs substantially greater than that of the conventional incandescent lamp for the same input electrical power. While an electrodeless light source according to the teachings of this patent has operated satisfactorily, there exists a need to further improve the efficacy of such light sources.

SUMMARY OF THE INVENTION

It is an object of the present invention to provide an electrodeless light source having improved operating characteristics.

It is an additional object of the invention to provide an electrodeless light source having a reduced power threshold level.

According to one aspect of the present invention, there is provided an improvement in an electrodeless light source of the type having a source of power at a high frequency and an electrodeless lamp having an envelope made of a light-transmitting material and a volatile fill material emitting light upon breakdown and excitation. The light source further has a termination fixture coupled to the source, the fixture having an inner conductor and an outer conductor disposed around the inner conductor. The lamp is disposed in the region of the first ends of the conductors and the source is coupled to the second ends of the conductors so that the lamp forms a termination load for the source. The fixture further has a device for matching the impedance of the lamp during the state of breakdown and excitation to the output impedance of the source. According to the invention, conductive and convective heat losses from the lamp envelope to the region between the conductors are reduced. In one aspect of the invention, this reduction in power loss due to heat conduction and transport by convection is obtained by evacuating the region at least in the vicinity of the periphery of the electrodeless lamp.

DESCRIPTION OF PREFERRED EMBODIMENTS

Figure 1:
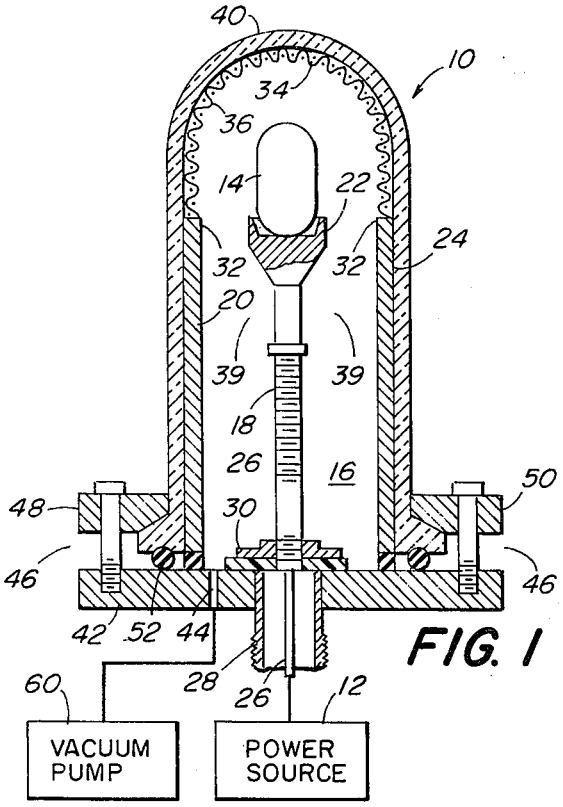
FIG. 1 is a partial sectional view of an exemplary embodiment of an improved electrodeless light source according to the invention.

In an exemplary embodiment of the present invention, as is illustrated in FIG. 1, there is provided an electrodeless light source, represented generally by the reference numeral 10. The light source 10 includes a source of power 12 at a high frequency. As used herein, the term high frequency is intended to include frequencies within the range of 10 MHz to 300 GHz. An electrodeless lamp 14 has an envelope made of a light-transmitting material, such as quartz, and a volatile fill material emitting light upon breakdown and excitation. One typical fill is 20 torr argon, 0.39 mg of sodium iodide, 0.36 mg of scandium iodide, and 0.2 $\mu$l of mercury in a lamp envelope volume of 0.41 $cm^3$. A termination fixture 16 is coupled to the source 12. The fixture 16 has an inner conductor 18 and an outer conductor 20 which is disposed around the inner conductor 18. The lamp 14 is disposed in the region of the first ends 22 and 24 of the inner and outer conductors 18 and 20, respectively. The source 12 is coupled to the second ends 26 and 28 of the conductors 18 and 20, respectively. The fixture includes a device for matching the impedance of the lamp during breakdown and excitation of the fill material to the output impedance of the source. This device includes a capacitor 30 coupled across the conductors at the source coupled end. For additional details on this impedance matching device, reference may be made to U.S. Pat. No. 3,943,403 which is incorporated by reference. A transparent dome 34 having a metallic mesh 36 encloses the upper end of the outer conductor. The mesh 36 is grounded at 32 to the outer conductor 20 to retain microwave energy inside the fixture.

According to the invention, means are provided for restricting the flow of heat from the lamp 14 to the region 39 between the conductors 18 and 20 by producing a thermally non-conductive and non-convective region at least around the periphery of the envelope of the lamp 14 to restrict the flow of heat. In FIG. 1, this feature is accomplished by evacuating the entire region 39 by the provision of a sealed, evacuated light-transmitting chamber 40 surrounding the outer wall of the outer conductor 20 and the dome 34. In addition, there is provided a support member 42 sealingly affixed to the second ends 26 and 28 of the inner and outer conductors 18 and 20, respectively, and being formed with an aperture 44 which communicates with the region 39 between the conductors. A pair of hold-down flanges 48 and 50 and an O-ring seal 52 seal the interface between the chamber 40 and the support member 42. Means, such as a vacuum pump 60, are coupled to the aperture 44 to evacuate the region 39.

Figure 2:
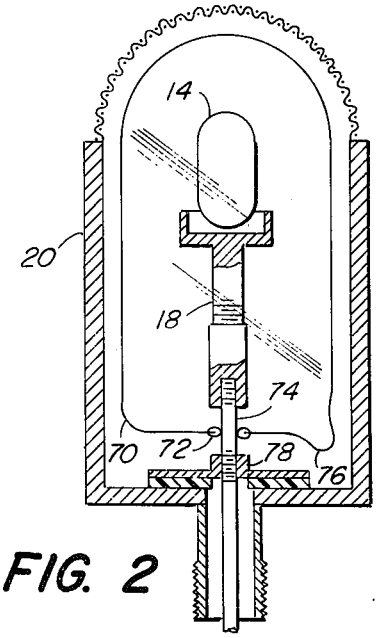
FIG. 2 is an alternative embodiment according to the invention.

FIG. 2 illustrates an alternative embodiment for defining an evacuated region around the lamp envelope and a portion of the inner conductor which is adjacent to the lamp. An evacuated glass envelope 70 is provided, the envelope having an aperture through which the inner conductor is positioned and a glass to metal seal 72 sealing the interface of the envelope 70 and a threaded member 74 forming a part of the inner conductor 18. In the fabrication of the envelope 70, the upper portion of the inner conductor including element 74, the lamp 14 and the envelope 70 are formed as a unitary assembly. The region is evacuated during fabrication by removing the gas with a vacuum pump which communicates with the internal region at a tip-off 76 of the envelope 70. In assembling the fixture, the lower threaded portion of the element 74 is inserted into a receiving threaded portion of the lower portion 78 of the inner conductor.

Figure 3:
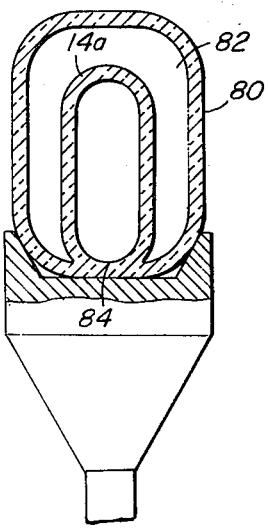
FIG. 3 is another alternative embodiment according to the invention.
Figure 4:
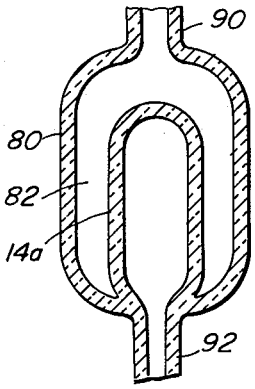
FIG. 4 is a diagram illustrating the method of fabricating the embodiment of FIG. 3.

FIG. 3 shows another exemplary embodiment wherein a lamp **14*a* is formed integrally with an outer envelope 80. The region 82 between the lamp 14*a* and the envelope 80 is the evacuated region for reducing convective and conductive heat losses. The envelope 80 surrounds the lamp 14*a* and is rigidly affixed thereto at a junction 84. FIG. 4 shows a preferred method of fabricating the lamp of FIG. 3. During fabrication, the envelope 80 is formed with an exhaust tube 90 through the region which is evacuated by a vacuum pump (not shown), and the lamp 14*a* is formed with a filler tube 92 through which the fill material is inserted into the region defined by lamp 14*a*. After filling and tip-off, the region 82 is evacuated and the top of the envelope 80 is closed and the tube 90** removed.

Figure 6:
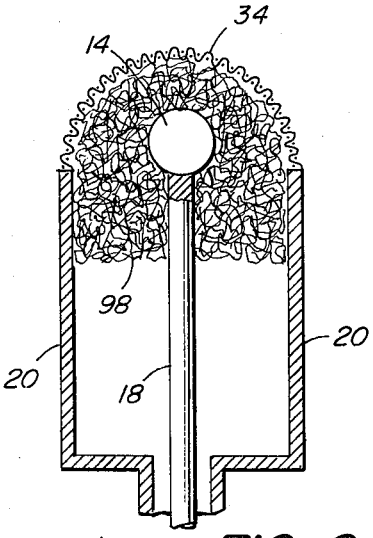
FIG. 6 is a diagram of still another embodiment of the present invention.
Figure 5:
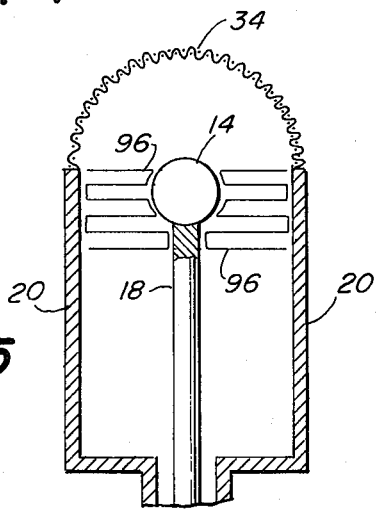
FIG. 5 is a diagram of another embodiment of the present invention.

FIGS. 5 and 6 illustrate alternative means for restricting primarily the flow of heat from the lamp 14 by convection. In FIG. 5, a baffle 96 is disposed in the region between conductors 18 and 20. The baffle, which is made of a refractory dielectric material with low thermal conductivity and low microwave loss, such as quartz, prohibits gas flow due to the heat generated by the lamp 14. In FIG. 6, a mass 98 of fiberous material made of a light-transmitting material, such as quartz, is disposed between the conductors 18 and 20 to restrict convective heat loss.

Figure 7:
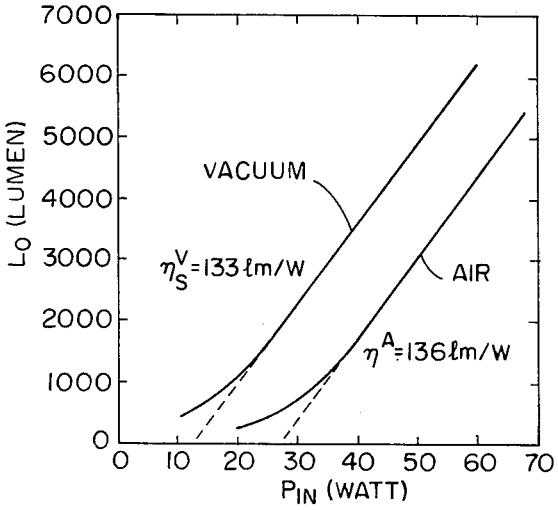
FIG. 7 is a graph illustrating comparative curves of light output as a function of input microwave power for evacuated and air filled termination fixtures.
Figure 8:
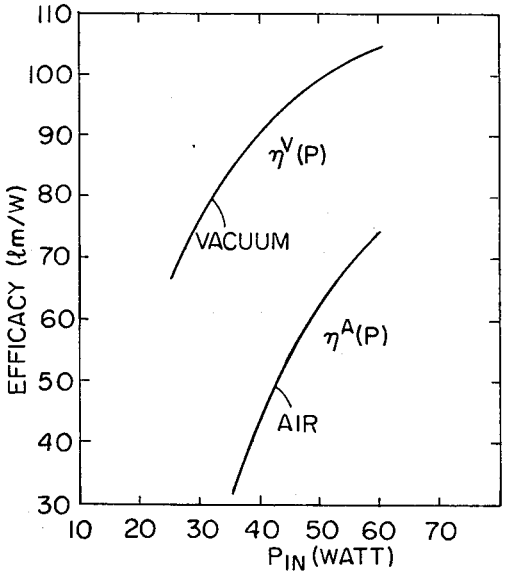
FIG. 8 is a graph illustrating comparative curves of efficacy as a function of input microwave power for evacuated and air filled termination fixtures.

FIG. 7 and FIG. 8 illustrate a comparison between the characteristics of the light source shown in FIG. 1 which has an evacuated region and the same light source except with the region between the conductors being air filled. The region 39 was evacuated at least to $5 \times 10^{-6}$ torr. Measurements of the light output as a function of microwave power at the input of the fixture were carried out in air and vacuum for several lamps. Typical light output characteristics are shown in FIG. 7 for lamp Sc61. In FIG. 7, the photo-optic light output is plotted vs. the microwave power input into the lamp at a microwave frequency of 0.917 GHz. For the air filled fixture, a slope efficiency of 136 *lm*/W, and a power threshold of 27 W was obtained. The power threshold is a measure of the losses in the lamp and is defined as the abscissa obtained by extrapolation of the linear part of the light output power curve to zero light output.

The measurements taken after evacuation of the outer envelope to an average pressure of $5 \times 10^{-6}$ torr over the run, showed a similar slope efficiency of 133 *lm*/W, and a power threshold of 27 W was obtained. The power threshold is a measure of the losses in the lamp and is defined as the abscissa obtained by extrapolation of the linear part of the light output power curve to zero light output.

The measurements taken after evacuation of the outer envelope to an average pressure of $5 \times 10^{-6}$ torr over the run, showed a similar slope efficiency of 133 *lm/W*, but a considerable improvement in the power threshold to 12.5 W was observed. The light output at 40 W in air is 1750 *lm*. In the evacuated lamp, the light output is increased by 111% to 3700 *lm* by removal of the free convection losses in the lamp.

The microwave power efficacy has been plotted in FIG. 8 for the measurements shown in FIG. 7. The microwave efficacy is the ratio of light output $L_O$ to the microwave power input $P_{in}$. The evacuated lamp shows a considerable improvement in efficiency over the air filled lamp and operates at an efficacy of more than 100 *lm*/Watt beyond 50 W of microwave power input.

The embodiments of the present invention are intended to be merely exemplary and those skilled in the art shall be able to make numerous variations and modifications of them without departing from the spirit and scope of the present invention. All such variations and modifications are intended to be within the scope of the present invention as defined by the appended claims.

We claim:

1. In an electrodeless light source having a source of power at a high frequency, an electrodeless lamp having an envelope made of a light-transmitting material and a volatile fill material emitting light upon breakdown and excitation and a termination fixture coupled to the source, the fixture having an inner conductor and an outer conductor disposed around the inner conductor, the lamp being disposed in the region of the first ends of the conductors and the source being coupled to the second ends of the conductors so that the lamp forms a termination load for the source, the fixture including means for matching the impedance of the lamp during breakdown and excitation to the output impedance of the source, an improvement comprising means for restricting the flow of heat from the lamp envelope to the region between the conductors.

2. The improvement according to claim 1 wherein the restricting means includes means producing a thermally non-conductive and non-convective region at least around the periphery of the lamp envelope to restrict the flow of conductive and convective heat therefrom.

3. The improvement according to claim 2 wherein the means producing the non-conductive and non-convective regions includes means defining an evacuated region at least adjacent the periphery of the lamp envelope.

4. The improvement according to claim 3 wherein the means defining the evacuated region includes a sealed evacuated light-transmitting chamber surrounding the outer conductor of the termination fixture.

5. The improvement according to claim 4 wherein the chamber includes:

a. a support member sealingly affixed to the second ends of the conductors and being formed with an aperture which communicates with the region between the conductors, the member being generally perpendicular to the conductors, b. a dome shaped member having an opening adapted to cooperate with the support member and being disposed around the outer conductor so as to enclose the first end of the conductors, c. means for sealing the junctions of the support member and the dome shaped member, and d. means coupled to the aperture in the support member for evacuating the dome shaped member.

6. The improvement according to claim 3 wherein the means defining the evacuated region includes an evacuated light-transmitting envelope surrounding the lamp and a portion of the inner conductor adjacent to the lamp, the envelope having an aperture through which the inner conductor is disposed and means for sealing the interface of the envelope and the inner conductor.

7. The improvement according to claim 3 wherein the means defining the evacuated region includes the lamp envelope being formed with a second light-transmitting envelope rigidly affixed to and surrounding the envelope enclosing the fill material, the region between the envelopes being evacuated.

8. The improvement according to claim 1 wherein the heat flow restricting means includes baffle means disposed in the region between the conductors for reducing convective heat losses.

9. The improvement according to claim 1 wherein the heat flow restricting means includes a mass of fibrous material made of a light-transmitting material disposed between the conductors for reducing convective heat losses.

* * * * *

UNITED STATES PATENT OFFICE

CERTIFICATE OF CORRECTION

Patent No. 4,065,701 Dated December 27, 1977

Inventor(s) Paul O. Haugsjaa and Alfred Feuersanger

It is certified that error appears in the above-identified patent and that said Letters Patent are hereby corrected as shown below:

Column 4, lines 3 through 10 should be deleted.

Signed and Sealed this

*Third* Day of *October 1978*

[SEAL]

*Attest:*

RUTH C. MASON
*Attesting Officer*

DONALD W. BANNER
*Commissioner of Patents and Trademarks*